United States Patent [19]

Cobos et al.

[11] Patent Number: 4,951,576

[45] Date of Patent: Aug. 28, 1990

[54] PLASTIC SUPPORT SURFACE STRUCTURE

[75] Inventors: Charles R. Cobos, Bryan; Gary A. Ludwig, Brenham, both of Tex.

[73] Assignee: Bryan Equipment Company, Inc., Bryan, Tex.

[21] Appl. No.: 258,924

[22] Filed: Oct. 17, 1988

[51] Int. Cl.[5] ..... A47B 3/00

[52] U.S. Cl. ..... 108/131; 108/901

[58] Field of Search ..... 108/131, 129, 132, 901, 108/902; 211/180; 312/3; 24/303

[56] References Cited

U.S. PATENT DOCUMENTS

| | | | |
|---|---|---|---|
| 236,741 | 1/1881 | Weaver | 108/131 |
| 2,389,298 | 11/1945 | Ellis | 24/303 X |
| 2,400,320 | 5/1946 | Trefry | 108/50 X |
| 3,213,570 | 10/1965 | Abramson, Jr. | 108/901 X |
| 3,365,684 | 1/1968 | Stemke et al. | 24/303 X |
| 3,378,893 | 4/1968 | Labek | 24/303 |
| 3,438,164 | 4/1969 | Duepree | 108/901 X |
| 3,880,092 | 4/1975 | Seeber et al. | 108/901 X |
| 4,399,975 | 8/1983 | Trimarco et al. | 108/901 X |
| 4,559,878 | 12/1985 | Colby | 108/129 X |

*Primary Examiner*—Jose V. Chen

*Attorney, Agent, or Firm*—Ned L. Conley; David A. Rose; William E. Shull

[57] ABSTRACT

A plastic-sandwiched framework structure for constucting a portable folding table. The structure includes upper and lower plastic table top halves and a framework grid sandwiched therebetween. The table top halves are bonded or cemented to one another. The framework grid is preferably made of wood, and includes joists or beam members interconnected by cross members. The framework grid is received in a correlatively shaped shell integrally formed in the lower half of the table top. Folding legs are mounted on the underside of the table top and connected through the lower table top half to the cross members. The lower table top half is provided with gussets at selected locations between relatively high vertical walls and the adjacent horizontal planar surfaces. Substantially all other interfaces between vertical and horizontal surfaces on the exterior of the lower table top half are provided with a radius. Stiffening ribs, which may be extensions of the shell, are also disposed on the lower table top half. A magnetic strip is mounted around the periphery of the table for attracting magnetic strips on a drapery for attaching the drapery to the table. The upper surface of the upper table top half may be provided with a woodgrain veneer.

16 Claims, 8 Drawing Sheets

PLASTIC SUPPORT SURFACE STRUCTURE

BACKGROUND OF THE INVENTION

The present invention relates generally to plastic support surface structures, and more particularly to a plastic-sandwiched framework structure which may be used, for example, for constructing a portable folding table, workbench, or other desired support surface.

Portable folding tables (and usually, portable folding chairs, as well) are virtually indispensable to many organizations or institutions which cater to the needs of large groups of people. Use of portable folding tables, rather than fixed or rigid types, allows the organizations or institutions to tailor the size and configuration of the table layout to the anticipated requirements of the group, while permitting any excess floor space to remain free or available for other uses and any extra tables on hand to be neatly and efficiently stored away. In the event that none of the folding tables are needed for a particular function or event, of course, they can all be stored away. Thus, use of folding tables permits such organizations or institutions to maximize the effectiveness and utilization of their available floor space and accompanying facilities, while minimizing the storage space requirements for the tables when they are not needed. Organizations or institutions which frequently have a need for such folding tables include hotels, restaurants, schools, churches, convention centers, factories, hospitals, governmental authorities or other public entities, and the like. Physical facilities in which such folding tables are likely to be used include gymnasiums, auditoriums, banquet or dance halls, meeting halls or rooms, cafeterias, field houses, and the like.

A major drawback with most prior art folding tables is their relatively great weight and bulkiness. Most of the folding tables of the prior art which are "banquet sized," or large enough to accommodate eight to ten adult persons comfortably, are so heavy and unwieldy that two people are usually required to set up, take down, or transport each table. Even then, the prior art folding tables are typically bulky enough so that two persons often have difficulty avoiding the strained muscles, smashed fingers or crunched toes which accompany accidents with or mishandling of the tables. Such unwieldy and relatively heavy prior art tables are typically made of fiber or particle board, plywood, or Masonite-type materials, and may also have a Formica type surface laminated onto one of the foregoing underlying materials. With materials such as these, virtually the only way to make the tables stronger or sturdier is to make the table tops thicker and heavier. Such prior art tables may weigh, for example, eighty to ninety pounds or more for a banquet-sized table. It is extremely difficult for one person properly to handle, manipulate, or transport tables of that size and weight by himself or herself. Even smaller tables of that construction, for example those accommodating about six adult persons comfortably, are heavy and bulky enough to cause one person inconvenience and difficulty, and significant risk of injury, if he or she attempts to handle them alone.

Another drawback with prior art tables such as those discussed above is that the means of attachment of the legs to the table tops tend to fail or give way prematurely, sometimes pulling completely away from the material used for the table top and either ruining it altogether, or necessitating bothersome or costly repairs. The repairs often require that bolts or nuts or the like protrude above the table top. This can be extremely unsightly, and can even render the table useless for some purposes. Again, virtually the only solution suggested by those skilled in the art to overcome this problem has been to make the table tops thicker and sturdier, necessarily resulting in a heavier table top as well. Thus, the so-called solution to that problem exacerbates the first problem discussed above, i.e., excessive weight and unwieldiness of most prior art folding tables.

Yet another problem with the prior art folding tables discussed above is that the materials used are susceptible to water damage. The materials tend to absorb water or other liquids coming into contact with them, which leads to decay or other deterioration. This makes it difficult to clean them without subjecting them to possible harm from exposure to liquids, and also can lead to disastrous results if the tables are left outside in the rain.

Still another problem with the above-referenced prior art tables is that they can splinter if subjected to improper loads, or even after periods of routine use, which can be hazardous to persons using the tables or to those setting them up, taking them down, or moving them.

One proposed solution of the prior art to the problems discussed above with the typical folding tables used in the past is to make the table tops from aluminum. Although relatively strong and lightweight, those prior art aluminum tables were prohibitively expensive for most organizations, and consequently were not an acceptable alternative. Furthermore, those aluminum tables tended to dent quite easily when subjected to the routine bumps and jars encountered with normal, everyday usage and handling. Such tables can also have sharp edges, posing a hazard like the splinters of the prior art tables discussed above. Yet another problem with those prior art aluminum tables is the clattering noise created by objects, such as metal flatware, when they strike the surface of the table top even relatively lightly, for example, when they are placed on the table top with less than extra care. In an enclosed space or room with perhaps dozens or even hundreds of persons seated at such tables for a meal, the clatter can easily rise to the level of a din and be quite uncomfortable. In order to avoid such a din, it is necessary that foam pads or the like be placed on the table tops, which add to the expense of the tables, require extra labor to set up and remove, require more storage space, and involve an extra replacement cost when they wear out. Still another problem with such prior art aluminum tables is that even with a properly finished surface, after a time aluminum will tend to rub off and leave gray streaks on skin or clothing which is inadvertently brushed against it. For all of these reasons, then, aluminum folding tables have not proved to be satisfactory alternatives to the typical prior art folding tables discussed above.

Often it is desired to cover the front and/or sides, and sometimes the back as well, of a portable folding table from the top surface of the table down to near floor level in order to conceal the table top structure and legs, and the space beneath the table top, from view. This is particularly true in the case of such a table being used, for example, as part of a display at a trade show, convention, or the like, or as a head table at a banquet or other assembly, where the attractiveness of the display or head table is important in meeting the needs and goals of the sponsors or attendees. The display or head table is simply much more pleasing to the eye, and more effective, if the possibly plain or unsightly table structure and legs are hidden from view. In addition, such a coverup arrangement allows the use of the space below the table top for storage of sales literature, brochures, or other materials. In order to accomplish this coverup, one prior art approach has been to mount drape clips at spaced apart locations on the edge of the table top, and then to affix a hanging drape to the clips. This procedure is fairly tedious and time-consuming, however, since it requires two distinct operations, each of which in turn entails a series of steps involving a significant amount of manual dexterity:

(1) placing all of the clips on the table edges, one by one, and (2) attaching the drapery to each of the clips, also one by one.

Furthermore, the drape clips must be stored and accounted for separately, and it is not uncommon for clips to be broken, lost, or misplaced when they are needed at the last minute. Another prior art approach has been to pin the drapery to the table cloth, but that is extremely slow and tedious. Other approaches which have been used, particularly with disposable drapes, are staples and double-sided tape. The staples are frequently left in the tables when the drapes are removed, posing a serious hazard to users or handlers. Tape is not acceptable for heavier fabrics, which are the more attractive compared to disposable drapes, since it will not hold up the drapery securely enough. Finally, all of the prior art draping systems are susceptible to being improperly aligned when installed, possibly resulting in a crooked, and therefore unsightly, drape.

It is an object of the present invention to overcome the problems of the prior art folding tables discussed above by providing a portable plastic folding table which is tough and durable enough to withstand without damage the normally expected wear and tear of extended periods of use, strong and sturdy enough to support the loads normally expected to be encountered in service, large enough to accommodate banquet-type seating at each table, but yet lightweight enough to be easily set up, taken down, and transported from place to place by one person with minimal risk of injury.

It is another object of the present invention to provide such a portable plastic folding table with leg attachment means which are strong, secure, reliable, and durable, will provide a positive mechanical connection between the table top and the legs, and will not tend to pull away from or damage the table top in service.

It is yet another object of the present invention to provide such a portable plastic folding table which is simple and inexpensive to manufacture, easy to use and store, available in a variety of shapes and sizes, and attractive.

Another object of the present invention is to provide such a portable plastic folding table which is waterproof, will not decay or deteriorate, will not splinter, and has no sharp edges.

Still another object of the present invention is to provide a draping system for such a portable plastic folding table which is also simple and inexpensive to manufacture, is self-centering or aligning, easy to use, and attractive.

SUMMARY OF THE INVENTION

According to the present invention, there is provided a plastic-sandwiched framework structure which may be used, for example, for constructing a portable folding table which overcomes all of the drawbacks of prior art folding tables discussed above. The invention includes an upper support surface member, a lower framework enclosing and stiffening rib supporting member, referred to herein as the upper half and lower half, respectively, of the table top, and a framework grid sandwiched between the upper and lower halves of the table top. The upper and lower table top halves are preferably made of thermoplastic or thermosetting plastic materials, and are bonded or cemented to one another with the framework grid between them. The framework grid is preferably made of wood, and includes a plurality of vertically disposed, or placed on edge with respect to vertical, joists or beam members interconnected by a plurality of horizontally disposed, or placed flat with respect to horizontal, cross members. The framework grid is disposed in a correlatively shaped shell or well network integrally formed in relief fashion in the lower half of the table top.

The cross members and joists are disposed at locations designed and adapted to provide structural support and rigidity to the plastic sandwiched table top structure, and attachment and positive mechanical support means for the folding legs of the table. The folding legs are bolted or otherwise secured to the cross members of the framework grid, through the lower table top half. The bolts or other fastening means are inserted through the cross members, through the lower table top half, and through an appropriate support plate on the legs, and the nuts or the like attached thereto, prior to affixing the upper table top half to the lower half. Thus, the legs cannot easily be pulled or pried away from the lower table top half, because of the positive mechanical connection between the bolts, cross members, and legs, with the lower table top half securely sandwiched between the support plate or the like of the legs and the preferably wooden support member.

The lower table top half is provided on its lower exterior surface with gussetts at selected locations between the substantially vertical planar walls of the shell or well portions which encase the joists, and the adjacent, substantially horizontal planar surfaces of the main body of the lower table top half. The lower exterior surface of the lower table top half is also provided with a radius or curvature at substantially all locations between the substantially vertical planar walls of the shell or well portions which encase the cross members, which are lower than the walls which encase the joists, and the adjacent horizontal planar surfaces of the main body. The gussetts and radius portions of the lower table top half provide increased structural support and rigidity for the table top, and prevent the plastic material from pinching, bending, tearing, cracking, or thinning out during manufacture or in service. The lower table top half is also provided with stiffening ribs integrally formed in relief fashion with respect to the adjacent horizontal planar surfaces of the main body. The stiffening ribs may be, for example, extensions of the shell or well network which encases the framework grid. The stiffening ribs provide increased structural support and rigidity for the table top.

The lower table top half has an upwardly projecting flange around its circumferential periphery which is received within an overlapping, downwardly projecting flange around the circumferential periphery of the upper table top half. A strip of magnetic metal or of tough, flexible, magnetic plasticized material or the like is mounted, for example by cementing or bonding, around the exterior face or outer side wall of the downwardly projecting flange around the upper table top half. A similar strip, or a plurality of separated strips or pieces, of magnetic metal or of such flexible magnetic plasticized material or the like is or are sewn into or otherwise affixed to a fabric or drapery which, when placed adjacent to the magnetic strip on the upper table top half, will cause the strips or magnetic pieces to be securely magnetically attached together and the drapery to be thus securely attached to the table top. Since the magnetic strip on the table top will usually be concealed by a table cloth when drapes are required, and the magnetic strip or pieces in the drapery may also be concealed within the fabric, the drapery attachment of the present invention is virtually completely concealed from view, substantially enhancing the attractiveness of the draped and covered table. It should be understood that either the strip on the table, or the strip or pieces in the fabric, or both, may be a magnet.

The upper surface of the upper table top half may be provided with a veneer or laminate of woodgrain appearance or other desired design. The veneer or laminate may be made of a plastic material, such as vinyl or low or high pressure plastic laminate, or of wood or wood products or other suitable materials, and may be bonded or cemented to the plastic upper table top surface.

BRIEF DESCRIPTION OF THE DRAWINGS

For a detailed description of the preferred embodiments of the invention, reference will now be made to the accompanying drawings, wherein.

DESCRIPTION OF THE PREFERRED EMBODIMENT

Figure 1:
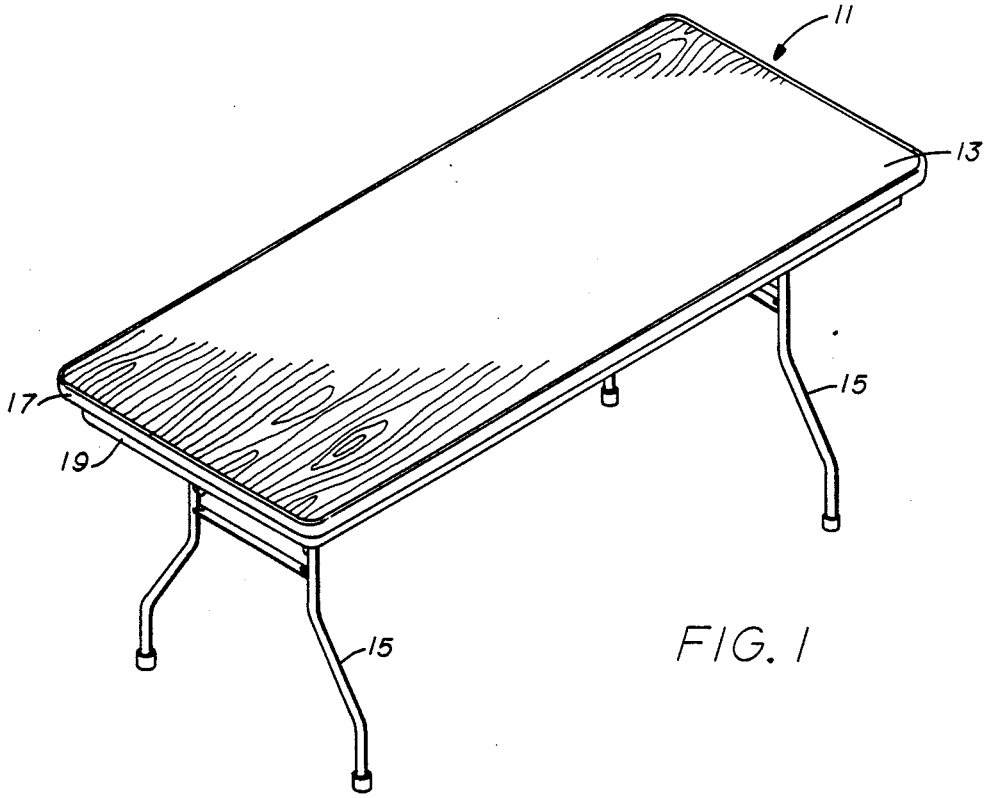
FIG. 1 is a top, side, and end isometric view of a representative rectangular embodiment of the portable plastic folding table of the invention.
Figure 2:
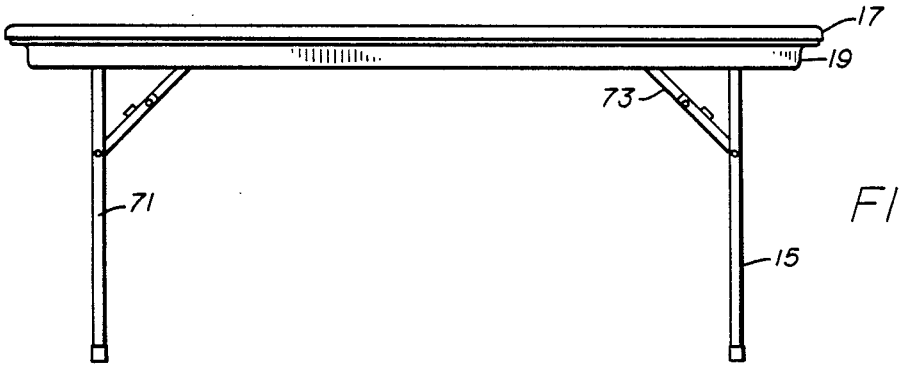
FIG. 2 is a side elevational view of the table of FIG. 1.

Referring initially to FIGS. 1 and 2, a representative portable folding table indicated generally at 11 comprises a plastic-sandwiched framework structure constructed according to the present invention. Table 11 broadly includes a table top 13 of a generally rectangular configuration, and two pairs of folding legs 15 attached to the underside of the table top. The table top 13 includes an upper support surface member or upper table top half 17, and a lower table top half 19. Lower table top half 19 includes a main body and a shell or well network formed therein for receiving and partially enclosing a wooden framework grid, as described further below. The lower table top half 19 also includes a plurality of stiffening ribs, also as described further below. The upper and lower table top halves 17, 19 are attached together, for example by bonding or cementing, with the wooden framework grid sandwiched therebetween.

The upper and lower table top halves are preferably made of a tough, durable, relatively strong, substantially water- or other liquid-impervious, and relatively lightweight plastic material. Either thermoplastic or thermosetting plastic materials may be used. A thermoplastic material known as acrylonitrile butyl styrene, or abs, works well, but other thermoplastics such as polyethylene, polypropylene, or the like, may be used instead. The upper and lower table top halves may be made with any suitable conventional plastic manufacturing process such as blow molding, injection molding, or vacuum molding.

The table top halves may be bonded or cemented together with any suitable adhesive or by any suitable process so long as a strong, permanent bond, and preferably one that is waterproof, is achieved between the halves. One adhesive that works well is an acrylic caulking material manufactured by Surebond, Inc., of Addison, Ill. Other suitable materials include a silicone caulking material, or a solvent-type cement.

Figure 9:
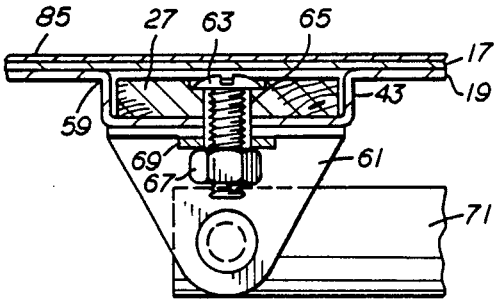
FIG. 9 is a fragmentary, vertical cross-sectional view of the table of FIG. 1, taken along lines 9—9 shown in FIG. 7, illustrating the means of attachment of the legs to the plastic sandwiched framework grid, and the laminate or veneer on the upper surface of the table.
Figure 10:
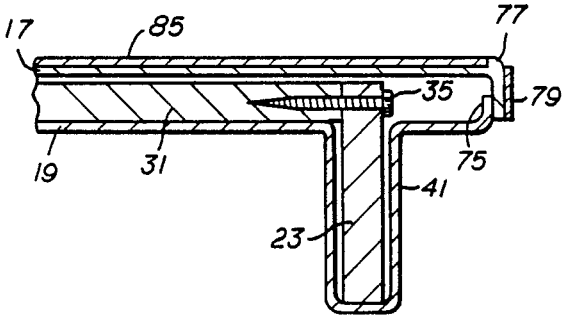
FIG. 10 is a fragmentary, vertical cross-sectional view of the table of FIG. 1, taken along lines 10—10 shown in FIG. 7, illustrating one of the joists and cross members of the framework grid in place between the plastic upper and lower table top halves, the laminate or veneer on the upper surface of the table, the overlapping flanges at the circumferential peripheries of the table top halves, and the magnetic drapery retaining strip mounted on the flange of the upper table top half.
Figure 12:
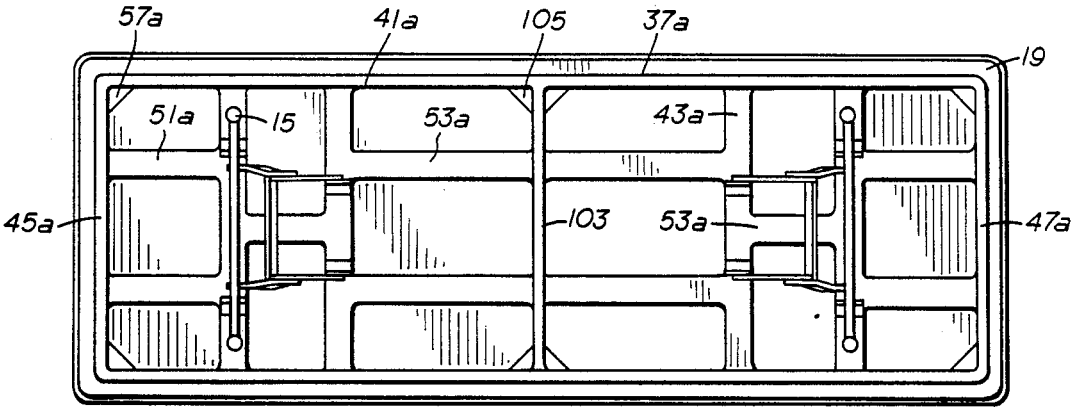
FIG. 12 is a bottom plan view of the table of FIG. 11.
Figure 13:
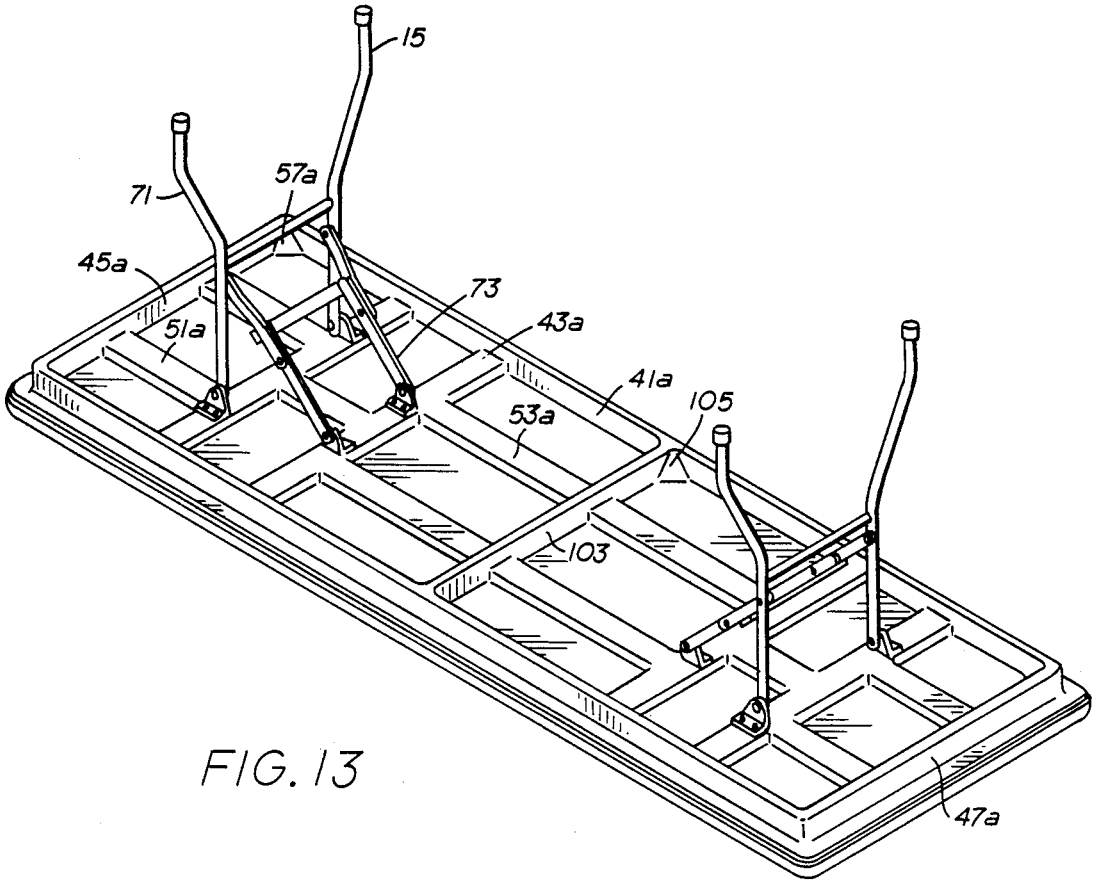
FIG. 13 is a bottom, side, and end isometric view of the table of FIG. 11.
Figure 14:
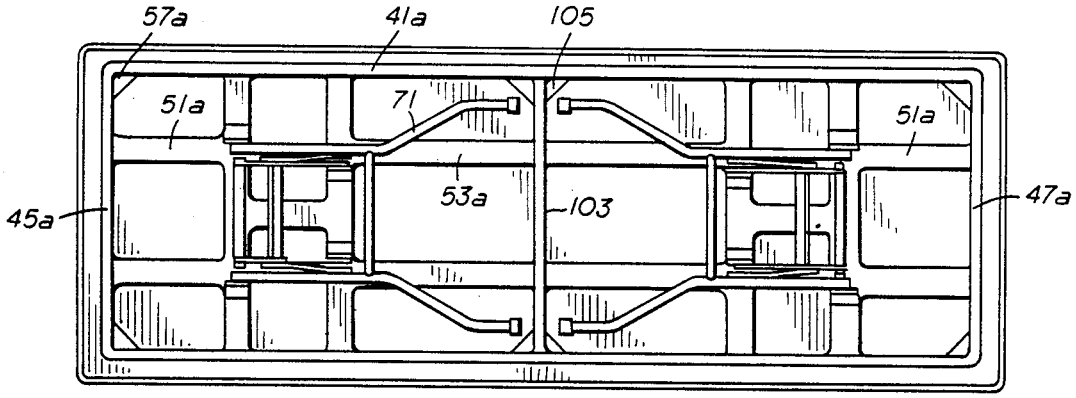
FIG. 14 is a bottom plan view of the table of FIG. 11 with the legs folded down.
Figure 15:
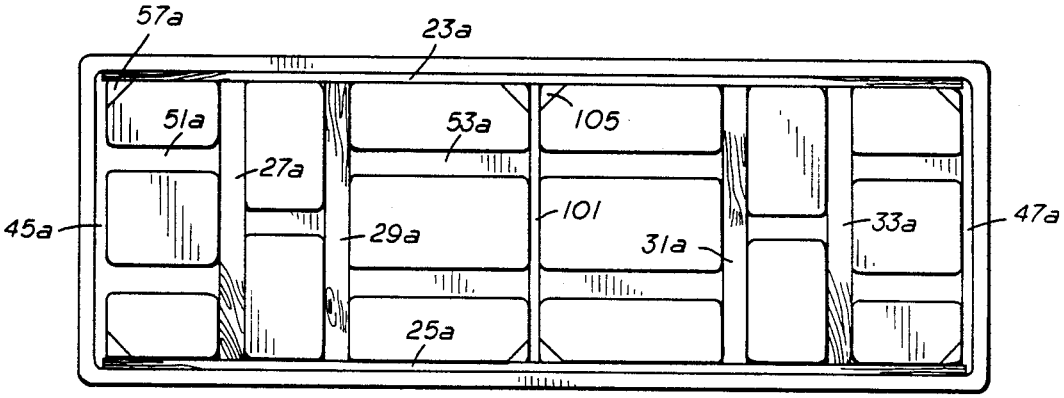
FIG. 15 is a top plan view of the lower half of the table top of FIG. 11 with the upper table top half removed, showing the framework grid in place in the shell and the stiffening ribs in the lower table top half.
Figure 16:
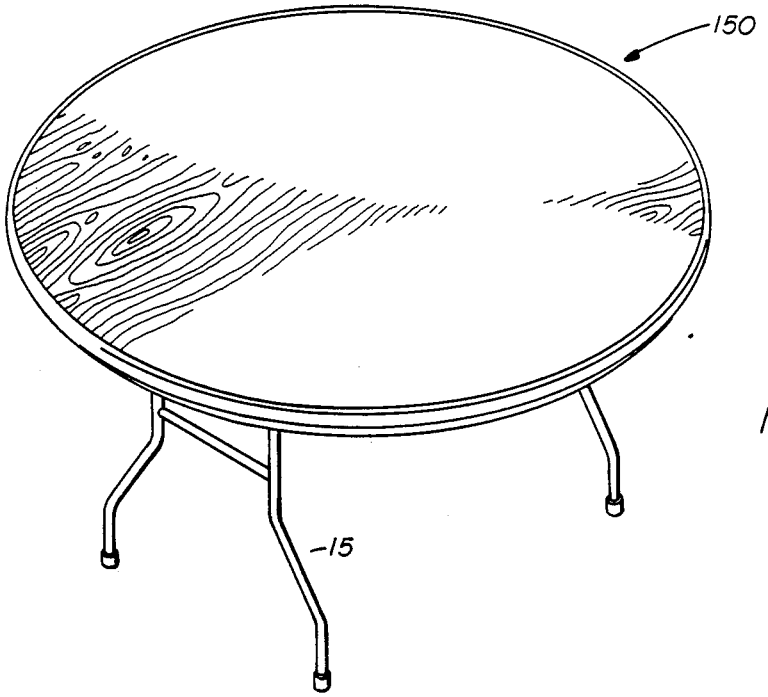
FIG. 16 is a top, side, and end isometric view of a round embodiment of the portable plastic folding table of the invention.
Figure 17:
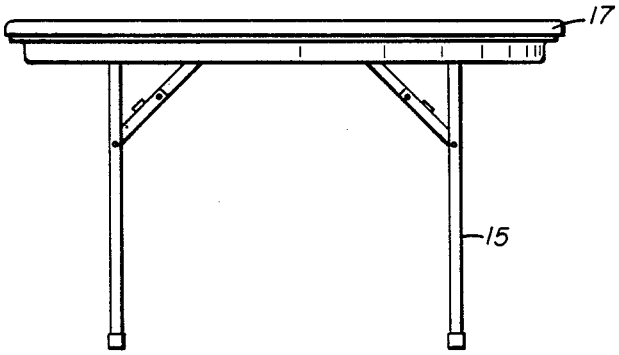
FIG. 17 is a side elevational view of the table of FIG. 16.
Figure 18:
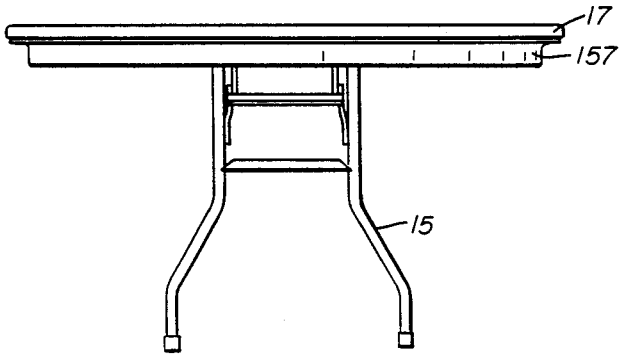
FIG. 18 is an end elevational view of the table of FIG. 16.
Figure 19:
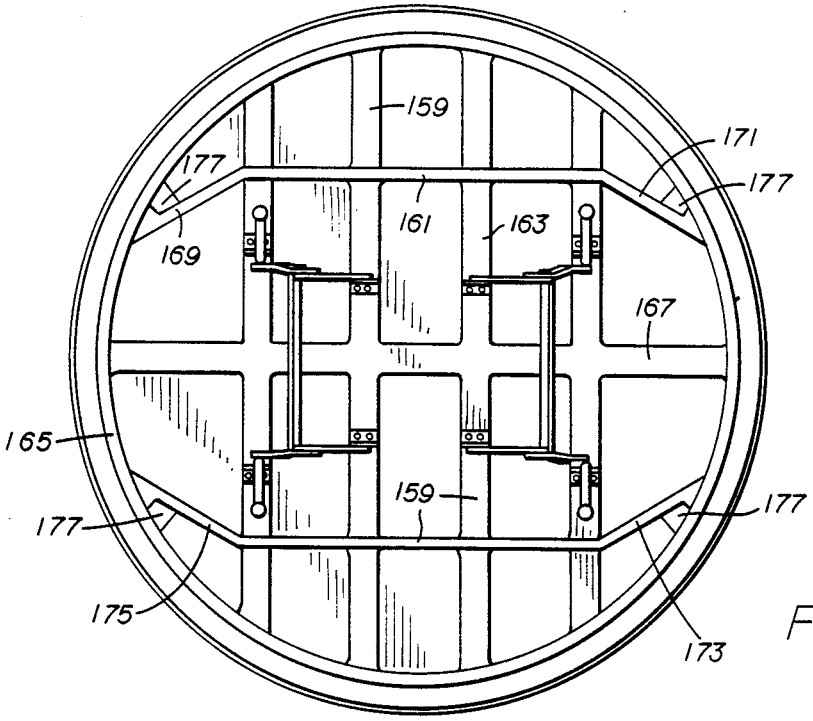
FIG. 19 is a bottom plan view of the table of FIG. 16.
Figure 20:
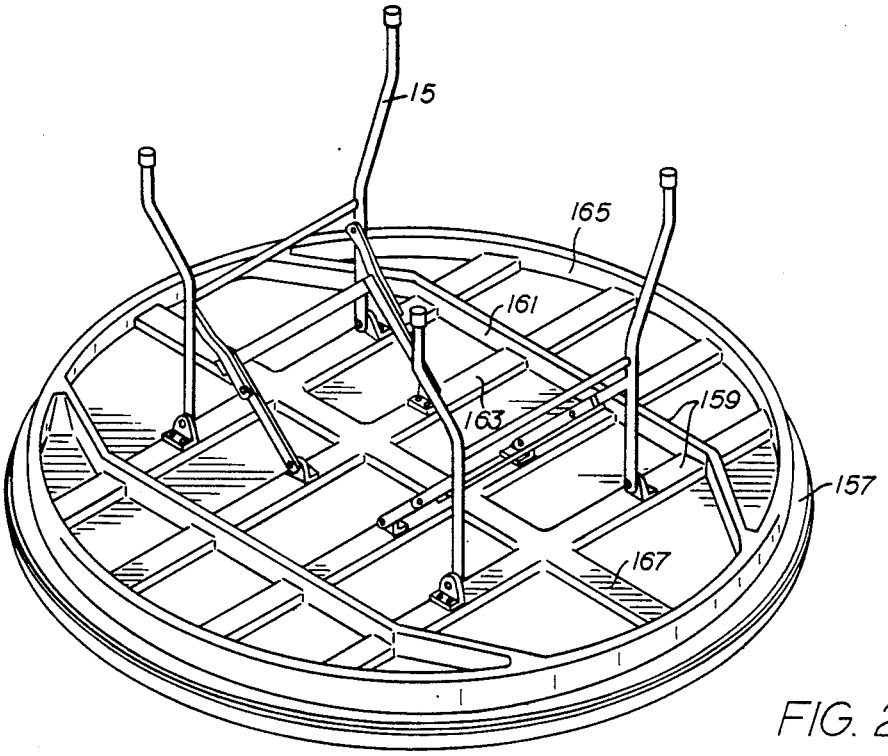
FIG. 20 is a bottom, side, and end isometric view of the table of FIG. 16.

Referring now to FIGS. 5–10, there is shown in more detail one alternative construction of a rectangular table incorporating the invention. FIGS. 9 and 10 show further details of construction which are common, however, to the other two embodiments of the invention described herein. The embodiment illustrated in FIGS. 5–10 is a relatively short one, i.e., one in which the length of the table is less in proportion to its width as compared, for example, to the embodiment shown in FIGS. 12–15. In the relatively short embodiment of FIGS. 5–10, a framework grid 21 is disposed between the upper and lower table top halves 17, 19. Framework grid 21 is made of a relatively strong, lightweight material such as wood or wood products, or plastic. It is preferably made of wooden boards, due to their low cost and the ease with which they may be drilled, cut, and fastened together.

Framework grid 21 includes a pair of longitudinally axially extending joists or beam members 23, 25 near the side edges of the table, and two pairs of transversely extending cross members 27, 29 and 31, 33 connected to the joists. Cross members 27, 29 are disposed near the midportion of one half of the table, and cross members 31, 33 are disposed near the midportion of the other half of the table. Cross member 27 is located about one-eighth of the table length in from the left end of the table (FIG. 7), and cross member 29 is located about one-quarter of the table length in from that left end. Cross members 31, 33 are located equivalent distances from the right end of the table. Joists or beam members 23, 25 are preferably flat wooden boards vertically disposed, or placed on edge with respect to vertical, and cross members 27, 29 and 31, 33 are preferably flat wooden boards horizontally disposed, or placed flat with respect to horizontal. Cross members 27, 29 and 31, 33 are connected to joists 23, 25 so that the upper flat faces of the cross members (when the table is upright as in FIG. 1) are substantially flush with the upper side edges of the joists, as shown, for example, in FIG. 10. The cross members may be connected to the joists with any suitable fastener, such as washerhead screws 35 (FIG. 10). In addition, the joints between the cross members and joists are glued to strengthen the connections. Any appropriate wood glue may be used.

Framework grid 21 is received in a shell or well network 37 integrally formed in relief fashion in the lower table top half 19. Shell 37 comprises a network of interconnected recesses substantially enclosing the framework grid, except for the upper surfaces of the joists and cross members, again with reference to the table in an upright position. Shell 37 is formed in the substantially flat main body 39 of lower table top half 19 during the manufacturing process referred to above. Shell 37 includes relatively deep portions 41 for receiving the joists 23, 25, and relatively shallow portions 43 for receiving the cross members 27, 29 and 31, 33.

Lower table top half 19 also includes a plurality of stiffening ribs integrally formed therein which are similar to the shell portions which partially encase the framework grid. The stiffening ribs may be viewed as extensions of the shell. Transverse stiffening ribs 45, 47 are disposed near the ends of the lower table top half between the shell portions 41 which encase the joists 23, 25, and are of substantially the same depth as shell portions 41. Transverse stiffening rib 49 is disposed near the center of the table and extends between shell portions 41, but is of substantially the same depth as shallow portions 43. Longitudinal stiffening ribs 51 extend between transverse ribs 45, 47 and the shallow shell portions 43 which encase the outermost cross members 27, 33, and longitudinal stiffening ribs 53 extend between shallow shell portions 43 toward the interior of the table. Ribs 51, 53 are of substantially the same depth as shallow portions 43. The shell 37 and stiffening ribs 45, 47, 49, 51, and 53 provide structural support and rigidity to the table top 13.

At each of the four interior corners 55 of the lower exterior surface of the lower table top half 19, there is disposed a ramp-shaped reinforcing member or gusset 57. Gussets 57 are integrally formed in the lower table top half like the shell 37 and the stiffening ribs. Gussets 57 are disposed between the intersecting shell portions 41 and ribs 45, 47, and the adjacent planar surface of the main body 39. Gussets 57 are of substantially the same height as shell portions 41 and ribs 45, 47. At substantially all other locations where a vertical surface of a shell portion or a stiffening rib meets the planar surface of main body 39, there is a radius or curvature in the lower exterior surface of the lower table top half, as shown at 59 in FIG. 9, providing a gradual transition from vertical surface to horizontal surface. Gussets 57 and curvature portions 59 provide increased structural support and rigidity for the table top 13, and prevent the plastic material from pinching, bending, tearing, cracking, or thinning out during manufacture or in service.

A plurality of brackets or leg support plates 61 are attached to the lower surface of lower table top half 19 by fastening means 63 such as screws, elevator bolts, threaded studs, or the like. Fastening means 63 are inserted through bores 65 in cross members 27, 29 and 31, 33, and through coaxial bores in the lower table top half 19 and brackets 61. Nuts 67 and washers 69 or the like securely attach the brackets 61 to the cross members of the framework grid, with the lower table top half securely sandwiched therebetween. Fastening means 63 are installed prior to attaching the upper table top half to the lower half. When such attachment is effected, care should be exercised to avoid placing any cement or adhesive between the framework grid and the table top halves, in order to allow the framework grid to "float" between the table top halves to the extent permitted by fastening means 63. This is to allow for thermal expansion or contraction of the table top halves, which in all likelihood will be greater than that of the framework grid. If the framework grid were to be bonded to the table top halves and such grater thermal expansion or contraction of the table top were to occur, the table top could be damaged.

Folding legs 15 include leg members 71 or struts 73 pivotally attached to brackets 61 in a conventional manner to provide a folding leg support system for table top 13.

As shown in FIG. 10, the lower table top half 19 includes an upwardly extending flange 75 around its circumferential periphery, which is received within a downwardly extending flange 77 on the circumferential periphery of the upper table top half 17. Flanges 75, 77 are bonded or cemented together, as referred to above. A strip 79 of magnetic metal or of tough, flexible, magnetic plasticized material or the like is mounted, for example by cementing or bonding, around the circumference of the table to the outer face of flange 77. One type of flexible plasticized magnetic material which may be used is known as Plastalloy 1A, and is made by the Electrodyne Co. of Batavia, Ohio. The magnetic metal or other material may be mounted on the flange 77 with the same adhesive, for example, as the one used to attach the table top halves together, but other adhesives, and other attachment means such as screws, nails, or tacks, can also be used. It should be understood that magnetic material strip 79 may be, but need not necessarily be, a magnet.

Figure 22:
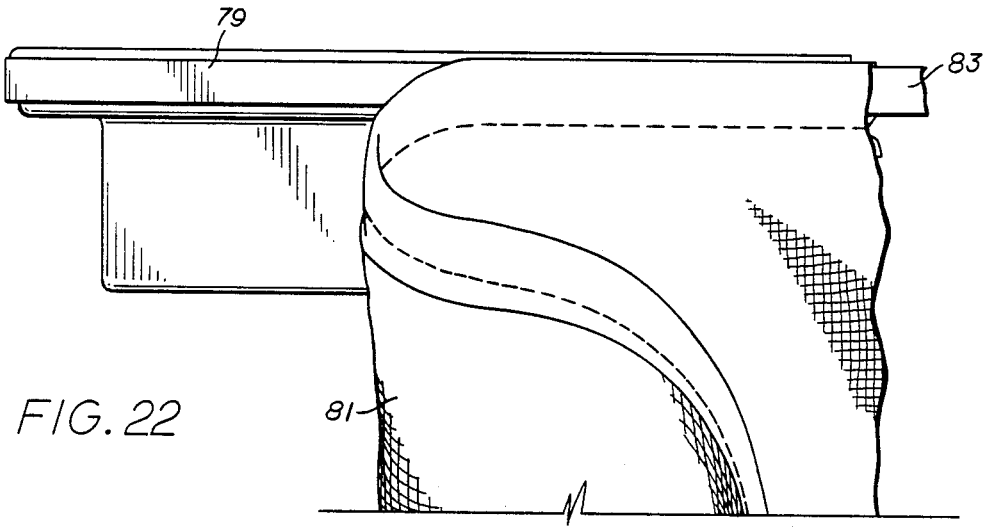
FIG. 22 is a fragmentary isometric view of the magnetic drapery attaching system of the invention, with part of the drapery folded away from the edge of the table top for clarity.

As shown in FIG. 22, drapery 81 includes a strip 83 of magnetic metal or of the same flexible plasticized magnetic material or the like as that used for strip 79. Strip 83 may be sewn into or otherwise attached to drapery 81, and may be a continuous strip running substantially the entire length of the drapery, or one of many smaller such pieces of magnetic material spaced at intervals along drapery 81. It should be understood that either material 83 or material 79, or both, may be magnets. Magnetic materials 79, 83 must have sufficient magnetic attraction between them to securely magnetically attach drapery 81 to table top 13. Such attachment will be readily effected merely by placing the magnetic materials 79, 83 adjacent one another, and due to the self-centering effect of such magnetic attachment, the drapery will be properly aligned or straight with respect to the table top.

As shown in FIGS. 9 and 10, the upper surface of the upper table top half may be provided with a veneer or laminate 85 of woodgrain appearance or other desired design. The veneer or laminate may be made of a plastic material, such as vinyl or low or high pressure plastic laminate, or of wood or wood products or other suitable materials, and may be bonded or cemented to the plastic upper table top surface.

The height of the overlapped flange portions 75, 77 from the upper surface 85 of table top 13 to the bottom of flange 75, i.e., the height of the edge of the table, is about ¾ inch. This will accommodate use of the prior art drape clips, if desired, and will also allow use of double sided tape and staples, if desired, to attach the drapery to the table.

It will be appreciated that the four outside corners of the table of the invention are rounded to avoid sharp edges. Also, by providing a rounded corner of about a 1" radius or less, there will not be a large gap between table corners when the tables are set up end-to-end, thereby providing added space at such table corners while at the same time eliminating possibly hazardous sharp edges.

Figure 3:
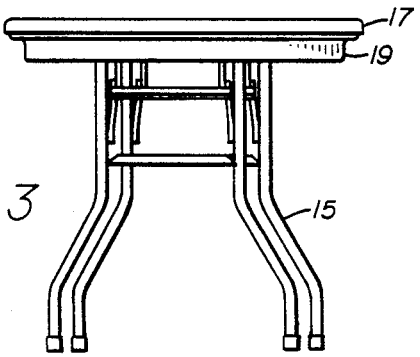
FIG. 3 is an end elevational view of a first alternative construction of the table of FIG. 1.
Figure 11:
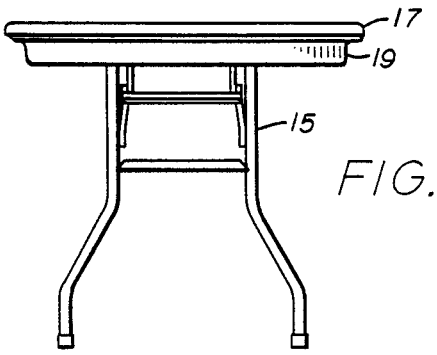
FIG. 11 is an end elevational view of a second alternative construction of the portable plastic folding table of FIG. 1.
Figure 4:
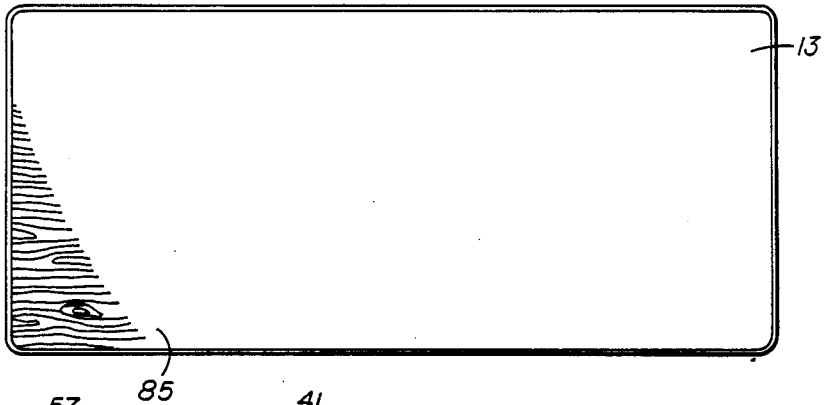
FIG. 4 is a top plan view of the table of FIG. 3.
Figure 5:
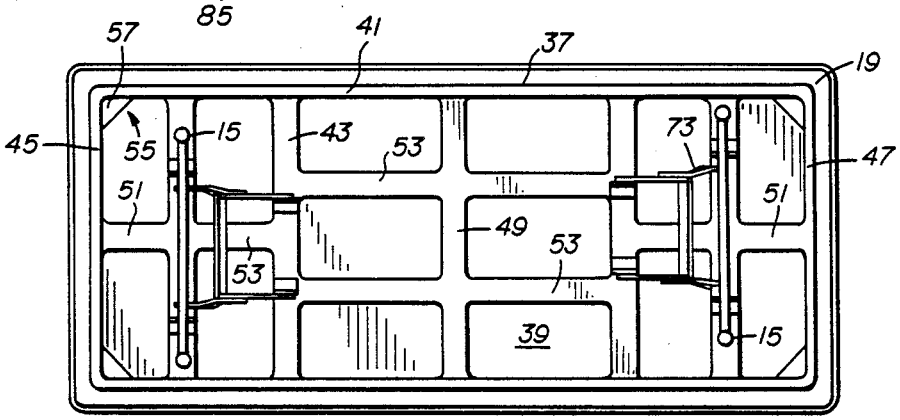
FIG. 5 is a bottom plan view of the table of FIG. 3.
Figure 6:
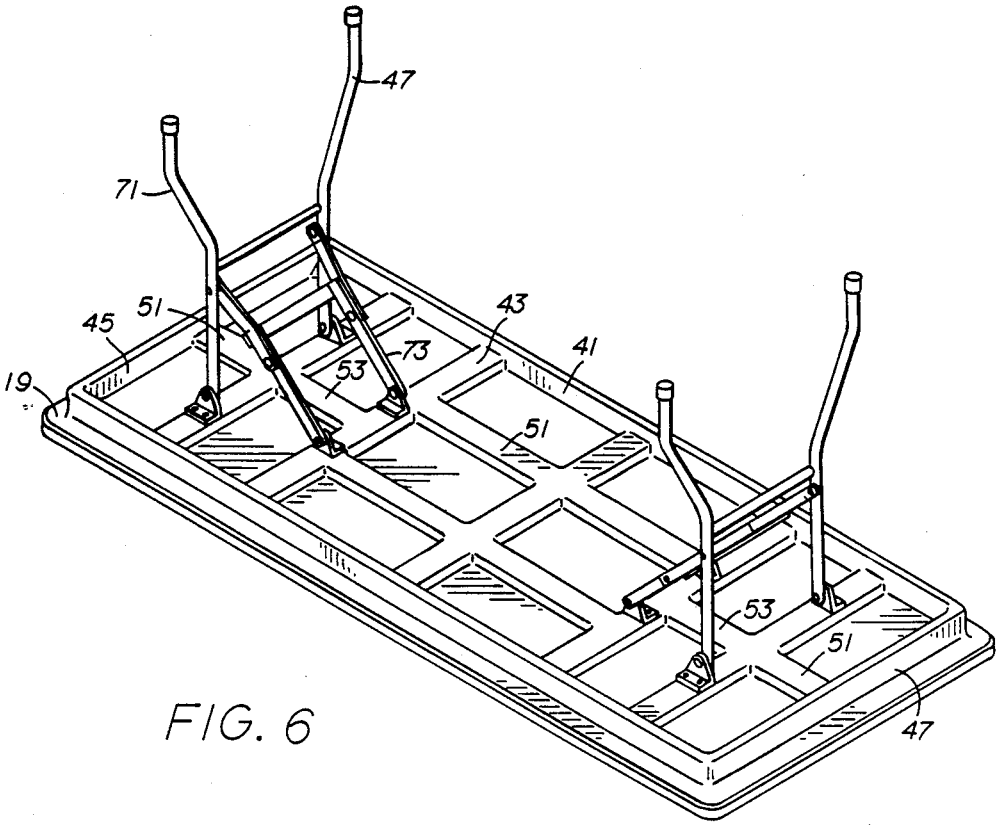
FIG. 6 is a bottom, side, and end isometric view of the table of FIG. 3.
Figure 7:
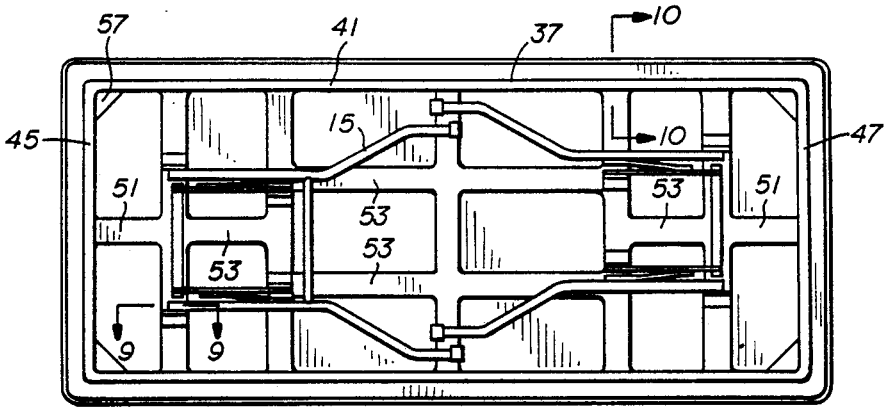
FIG. 7 is a bottom plan view of the table of FIG. 3 with the legs folded down.
Figure 8:
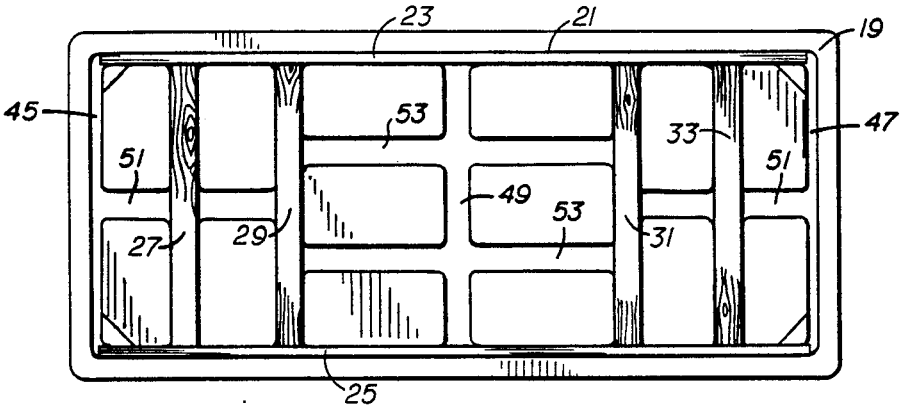
FIG. 8 is a top plan view of the lower half of the table top of FIG. 3 with the upper table top half removed, showing the framework grid in place in the shell and the stiffening ribs in the lower table top half.

Referring now to FIGS. 12–15, there is shown a second alternative construction of a rectangular table incorporating the invention. The table of FIGS. 12–15 is longer as compared to its width than the table of FIGS. 5–10. The table of FIGS. 12–15 differs from that of FIGS. 5–10 in having an additional transverse joist 101 disposed near the center of the lower table top half 19 instead of transverse rib 49, and two stiffening ribs **51*a* near each of the ends of the table rather than one rib 51. Shell 37*a* of this embodiment of the invention includes relatively deep portion 103 to receive transverse joist 101. The table of FIGS. 12–15 also differs from the embodiment of FIGS. 5–10 in having four additional gussets 105 disposed at the intersections of shell portions 41*a*, 103 and the main body 39*a* of the lower table top half. Also, since the two pairs of legs of the table of FIG. 7 would interfere with one another when folded if they were coaxially aligned, they are slightly offset from one another (FIG. 3), but no such interference can occur in the table of FIG. 14 so the two pairs of legs can be coaxially aligned (FIG. 11). Other than as set forth above, the details of construction of the two rectangular embodiments are substantially identical, so no further description of the relatively longer one is necessary. It should be noted that elements in the embodiment of FIGS. 12–15 which have their substantial counterparts in FIGS. 5–10** have been numbered with the same reference numeral with an "a" added.

Figure 21:
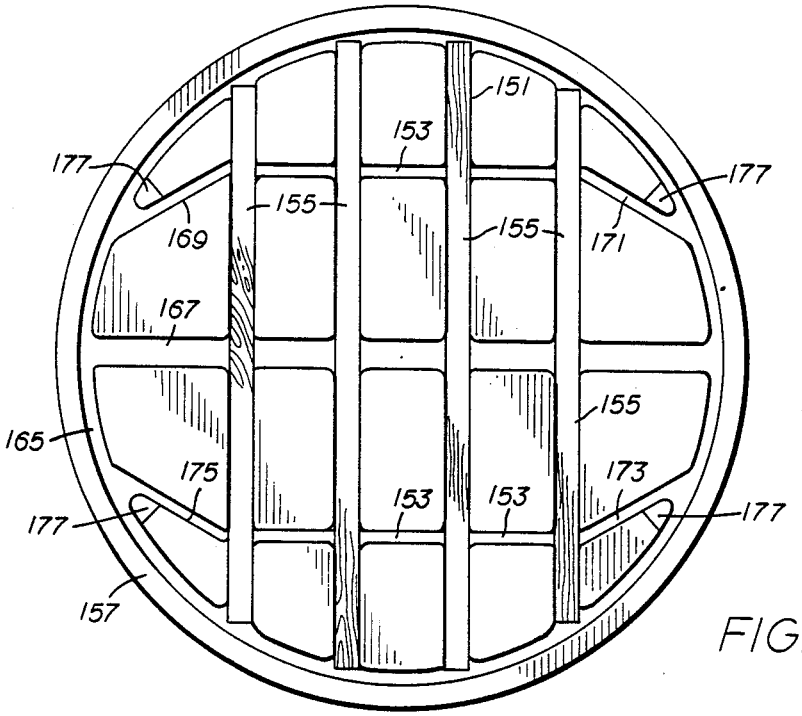
FIG. 21 is a top plan view of the lower half of the table top of FIG. 16 with the upper table top half removed, showing the framework grid in place in the shell and the stiffening ribs in the lower table top half.

Referring now to FIGS. 16–21, there is shown a round embodiment of a table incorporating the invention. This embodiment, indicated generally at 150, includes a framework grid 151 comprising a pair of longitudinally extending joists 153 and a plurality of transversely extending cross members 155 connected thereto. Cross members 155 are secured to joists 153 by, for example, countersunk wood screws 154 (FIG. 21). The joints between grid members 153, 155 are also glued, as are the wood joints for the two rectangular embodiments. The lower table top half 157 includes a shell or well network 159 formed therein for receiving the grid 151. Joists 153 rest in relatively deep shell portions 161, and cross members 155 rest in relatively shallow shell portions 163. Joists 153 extend substantially the length of the framework grid from the rightmost cross member (FIG. 19) to the leftmost cross member, and the cross members 155 extend substantially from one side to the other of a circumferentially extending stiffening rib 165 near the edge of the lower table top half. Stiffening rib 165 is about the same depth as the shell portions encasing the joists.

A longitudinally axially extending shallow stiffening rib 167 extends diametrically across the exterior surface of the lower table top half from one side of rib 165 to the other. Rib 167 is about the same depth as the shell portions 163 which encase cross members 155.

Stiffening ribs 169, 171, 173, and 175 extend angularly from the ends of shell portions 161 toward the longitudinal axis of table 150, i.e., toward rib 167. Ribs 169, 171, 173, and 175 are about the same depth as shell portions 161 and rib 165, and extend to and intersect rib 165. Gussets 177 are disposed at each location where ribs 169, 171, 173, and 175 meet rib 165, on the acute angled side where such members intersect. The gussets are of substantially the same height as the intersecting ribs, and extend between such intersecting ribs and the adjacent planar surface of the lower table top half in ramp-like fashion. The gussets serve the same purpose as those described above in connection with the rectangular embodiments. In addition, a radius or curvature is located at all other locations where a vertical surface of a stiffening rib or shell portion joins the planar surface of the main body of the lower table top half.

The other details of construction of the round embodiment of the table of the invention are similar to those described above, e.g., attachment of the legs to the cross members of the framework grid, the drapery mounting system, the veneer on the upper surface of the table top, and fastening of the upper and lower table top halves together.

It can be seen, therefore, that applicants' invention provides a plastic-sandwiched framework structure which can be used to construct a folding table, or other desired work surface, which is tough, strong, durable, waterproof, and lightweight, weighing, at between 40 to 50 pounds for a banquet-sized table, only about one-half as much as the non-aluminum prior art tables described above and having none of the disadvantages of such prior art aluminum tables. It can also be appreciated that the tables of the invention accomplish all of the other objectives discussed above. Those skilled in the art will appreciate that the attributes and advantages of the invention listed or discussed above are only representative, and not exhaustive. It will also be appreciated that modifications to the described preferred embodiments of the invention can be made without departing from its substance and spirit. For example, at any location where a stiffening rib is disclosed, a wooden framework grid member may be added for increasing the strength of the table.

We claim:

1. A plastic-sandwiched framework structure, comprising:

a plastic upper half member;

a plastic lower half member;

a framework grid disposed between said upper and lower half member, said members being affixed to one another;

said framework grid comprising at least one joist member running longitudinally axially of said structure and at least one cross member running transversely of said structure, said cross member being connected to said joist member;

said lower half member including a planar main body portion having a lower exterior surface and a shell integrally formed in relief fashion in said lower half member and shaped to receive and partially enclose said framework grid, said shell having downwardly depending, spaced apart, opposed walls and a substantially planar bottom portion interconnecting said opposed walls, the walls of said shell being substantially perpendicular to said main body portion, said shell including at least one relatively deep portion with relatively long opposed shell walls for receiving said joist and at least one relatively shallow portion with relatively short opposed shell walls for receiving said cross member;

the lower exterior surface of said lower half member including gusset means connected between the relatively long opposed shell walls and the lower exterior surface of the planar main body portion of said lower half member at selected locations where the planes of said relatively long opposed shell walls of said relatively deep portions of said shell intersect the planes of said lower exterior surface of said planar main body portion for providing increased structural support and rigidity for the framework structure and for maintaining structural integrity of the plastic comprised in said lower half member; and fastening means disposed through said cross member and said lower half member and extending beyond the lower exterior surface thereof and adapted for attachment to an external supporting member for supporting said plastic-sandwiched framework structure off the floor or other base surface.

2. A structure according to claim 1, wherein the lower exterior surface of said lower half member includes radius portions at substantially all of the interfaces of the downwardly depending walls of said shell and said planar main body portion other than at the locations of said gusset means.

3. A structure according to claim 1, wherein said shell includes at least one relatively deep stiffening rib integrally formed in relief in said lower half member, said rib joining said joist-receiving relatively deep shell portion at said gusset means, said gusset means extending between said rib, said joist-receiving relatively deep shell portion, and said planar main body portion.

4. A structure according to claim 3, wherein said framework grid further includes at least one transversely extending joist near the center of said structure, said shell includes a relatively deep transverse portion for receiving said transversely extending joist, said relatively deep transverse shell portion intersecting said relatively deep shell portion which receives the longitudinally extending joist, and further including additional gusset means at the intersection of said relatively deep transverse shell portion and said relatively deep shell portion which receives the longitudinally extending joist, said additional gusset means extending between said intersecting shell portions and the lower exterior surface of the planar main body portion adjacent the intersection of said shell portions.

5. A structure according to claim 3, wherein said shell includes at least one relatively shallow, longitudinally extending stiffening rib extending between said relatively deep stiffening rib and the shell portion partially enclosing said cross member.

6. A structure according to claim 5, wherein said shell further includes a relatively shallow transverse stiffening rib at the center of said structure, intersecting said longitudinally extending joint-receiving shell portion.

7. A structure according to claim 6, said framework grid further including a second cross member and said shell further including a second relatively shallow portion for receiving said second cross member and a relatively shallow stiffening rib extending between said cross member-enclosing shell portions.

8. A structure according to claim 1, wherein said upper and lower half members are circular, said structure having a longitudinal axis comprising a diameter of said structure, and wherein said shell includes a relatively deep circumferentially extending stiffening rib near the periphery of said lower half member, said joist member is spaced from the longitudinal axis of said structure, and said shell includes an angularly disposed relatively deep stiffening rib extending from said relatively deep shell portion which receives said joist to said circumferentially extending rib and making an acute angle therewith, and there is further included additional gusset means disposed at the intersection of said angularly disposed rib, circumstantially extending rib, and said lower exterior surface of said planar main body portion.

9. A structure according to claim 8, wherein the lower exterior surface of said lower half member includes radius portions at substantially all of the interfaces of the downwardly depending walls of said shell and said planar main body portion other than at the locations of said gusset means.

10. A structure according to claim 1, wherein said lower half member includes an upwardly extending flange around its circumferential periphery and said upper half member includes a downwardly extending flange around its circumferential periphery, said upwardly extending flange being overlapped by said downwardly extending flange, and further including a strip of magnetic material mounted on the outer side surface of said downwardly extending flange.

11. A structure according to claim 10, and further including a drapery and magnetic material affixed to said drapery, either or both of said strip of magnetic material on said flange and said magnetic material on said drapery being magnets for magnetically attracting one another and magnetically attaching said drapery to the plastic-sandwiched framework structure.

12. A structure according to claim 1, and further including a veneer or laminate on the upper surface of said upper half member.

13. A structure according to claim 12, wherein said veneer or laminate has a woodgrain appearance.

14. A structure according to claim 13, wherein said veneer is made of vinyl.

15. A structure according to claim 13, wherein said veneer is made of low pressure plastic laminate.

16. A structure according to claim 13, wherein said veneer is made of high pressure plastic laminate.

* * * * *